US005687896A

United States Patent [19]

Clift

[11] Patent Number: 5,687,896

[45] Date of Patent: Nov. 18, 1997

[54] PERSONAL ARTICLE STORAGE APPARATUS

[76] Inventor: Kelli A. Clift, P.O. Box 147, Culver City, Calif. 90232

[21] Appl. No.: 606,607

[22] Filed: Feb. 26, 1996

[51] Int. Cl.[6] ..... A45F 5/00

[52] U.S. Cl. ..... 224/587; 224/623; 224/625

[58] Field of Search ..... 224/602, 623, 224/625, 626, 587, 624, 683, 610, 206, 208

[56] References Cited

U.S. PATENT DOCUMENTS

| | | | |
|---|---|---|---|
| 2,372,971 | 4/1945 | Moore | 224/626 X |
| 3,091,378 | 5/1963 | O'Dwyer | 224/683 X |
| 4,763,821 | 8/1988 | Powell | 224/587 X |
| 4,872,599 | 10/1989 | Hubbard et al. | 224/625 |
| 5,135,144 | 8/1992 | Blakely et al. | 224/683 X |
| 5,263,618 | 11/1993 | Talavera | 224/624 X |
| 5,533,655 | 7/1996 | Duque | 224/602 |

*Primary Examiner*—Renee S. Luebke
*Attorney, Agent, or Firm*—Erik M. Arnhem

[57] ABSTRACT

An article storage apparatus includes a flexible panel that can be held against the upper torso of a person by an upper strap looped around the person's neck and a lower strap running around the sides and back of the person. The panel provides a support surface for a plurality of pocket structures that are sized to carry various articles normally carried by a person in a purse or in the person's pants pockets. The apparatus provides additional storage capacity for a person wearing conventional pants, or a primary storage device for a person wearing some other garment, such as shorts or a track suit.

1 Claim, 2 Drawing Sheets

PERSONAL ARTICLE STORAGE APPARATUS

BACKGROUND AND SUMMARY OF THE INVENTION

This invention relates to an article storage apparatus and particularly to an article storage apparatus adapted to be worn by a person while moving from place to place.

One well known personal article storage apparatus comprises a pouch having a zippered opening for closing the the pouch, whereby small articles can be retained in the pouch. A strap or band is attached to the pouch for encircling the person's waist, such that the pouch is positioned against the person's stomach at waist level.

One disadvantage of the conventional stomach pouch is that the pouch provides only a single compartment for all of the articles that are to be contained within the pouch. The various articles become intermingled so that it is sometimes difficult for the person to pick out a specific article needed at a particular moment. Typically the pouch is used to contain such articles as a comb, pencils, pens, wallet, handkerchief, lipstick, candy bar, loose coins, dollar bills, and personal protection devices. In some instances it may be a problem to select one particular article for withdrawal from a stomach pouch containing a variety of different articles.

Another problem with conventional stomach pouches is that the pouch storage capacity (volume) is somewhat limited. The pouch location on the person's stomach somewhat limits the size and thickness of the pouch, since a large pouch dimension could interfere with a normal walking motion or sitting motion.

The present invention is directed to an article storage apparatus adapted to be worn on the upper torso area of the person, either on the person's chest or on the person's side below one arm (similar to the procedure used when wearing a gun holster in a concealed weapon environment).

The article storage apparatus preferably comprises a flexible panel adapted for positionment against a person's upper torso for supporting a plurality of article-containment pocket structures. Typically, the apparatus will comprise four separate pocket structures.

Each pocket structure can be used to contain a specific article or relatively few articles that it is desired to be kept separate from other articles. The location of the article storage apparatus on the person's upper torso enables the support panel (for the pocket structures) to have a relatively great face area. This enables the panel to support a relatively large number of article containment pocket structure. The total storage volume is reasonably large and sufficient for most purposes.

The article storage apparatus of the present invention can be worn by the person in either a concealed condition or an exposed condition, e.g. underneath the person's suit coat or jacket, or over the person's shirt or sweater.

The attached drawings illustrate one preferred form of the invention, and provide a basis for a more complete understanding of the invention.

IN THE DRAWINGS

Figure 1:
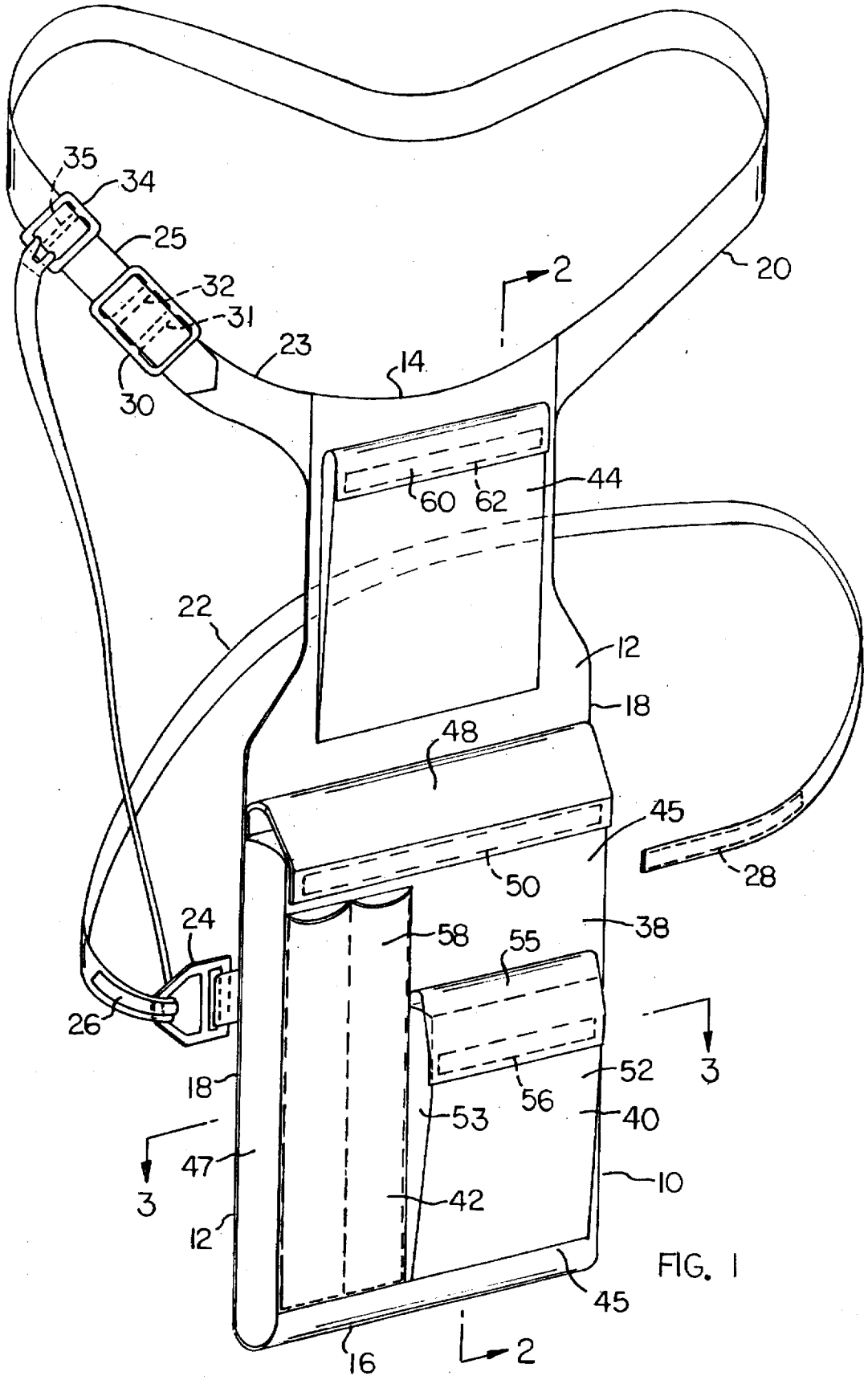
FIG. 1 is a perspective view of an article storage apparatus embodying the invention.
Figure 2:
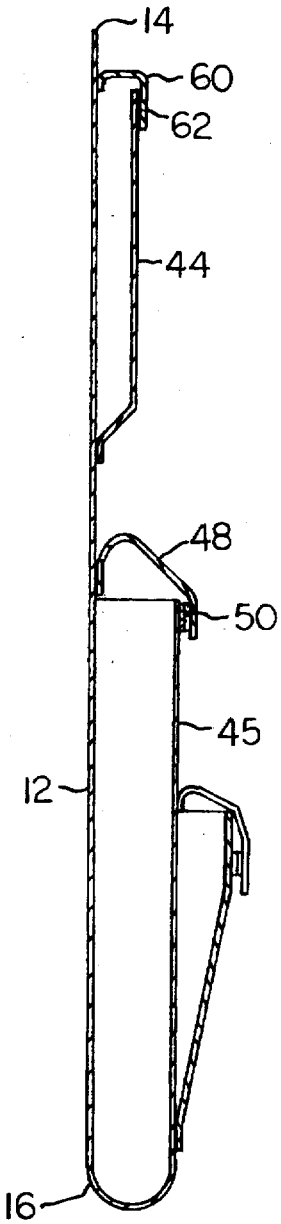
FIG. 2 is a longitudinal fragmentary sectional view taken on line 2—2 in FIG. 1.

Referring to FIG. 1, there is shown an article storage apparatus 10 adapted to store various small articles that might be carried by a person while moving from place-to-place. The apparatus serves the function of person's purse or pants pockets. Typically, the apparatus will be used to carry (store) such articles as combs, pens, pencils, wallet, loose coins, candy bar, bills, writing paper, and pill container. The apparatus is designed to be worn on the upper torso area of a person, either on the chest or underneath one arm of the person.

Apparatus 10 comprises a flexible panel 12 formed e.g. of leather or heavy plastic. The panel has an upper edge 14, lower edge 16, and two side edges 18. An upper strap means 20 is connected to the panel at the panel corners formed at the junctures between upper edge 14 and side edges 18. Strap means 20 forms a flexible loop adapted to extend around a person's neck or around the person's shoulder. The object is to position the panel 12 against the person's upper torso, while preventing the panel from Gravitating downwardly; strap means 20 serves as a suspension device for panel 12.

A lower strap means 22 is connected to panel 12 so as to be extendable in a generally horizontal plane around the upper torso of the person. One end of strap means 22 is adjustably attached to an anchorage element 24 located at one side edge of panel 12; element 24 can be formed of rigid plastic or as a metal stamping. The strap means is adapted to extend from anchorage element 24 around and behind the person's back, then forwardly along the person's opposite side, and finally across the person's chest area to an attachment point proximate to anchorage element 24.

In the illustrated apparatus the strap means 22 is retained in position by conventional hook-and-loop fibrous fastener patches, e.g. the fastener devices commonly available under the trademark VELCRO. Such patches have adhesive attachment properties when they are positioned flatwise against one another. As shown in FIG. 1, strap means 22 has a first adhesive patch 26 located in the vicinity of anchorage element 24, and a second adhesive patch 28 located near the free end of the strap means.

Strap means 22 can be trained around the person's torso, a few inches above waist level, such that the right end area of strap means 22 passes transversely across the panel 12, to enable adhesive patch 28 to mate with patch 26. The strap means thereby retains panel 12 against separation from the person's torso. Each patch 26 or 28 is elongated along the strap longitudinal axis, to enable the strap means to adapt to variations in the person's circumferential (girth) dimension. Additionally, the strap means is preferably formed of an elastic material so as to be stretchable (expandable) around the person's torso, if necessary.

Referring to upper strap means 20, there is provided a mechanism for adjusting the effective length of the strap means, whereby the strap mechanism can be accommodated to persons' having different heights, e.g. tall or short. The length adjustment mechanism can comprise a clamp element 30 in the form of a hollow rectangular frame having two cross bars 31 and 32.

Strap means 20 comprises a first strap element 23 extending from panel 12 and having a loop end encircling cross bar 31, such that strap element 23 is rigidly attached to clamp element 30. Strap means 20 further comprises a second strap element 25 (appreciably longer than strap element 23). Strap element 25 extends through clamp element 30 so as to overlie cross bars 31 and 32, whereby the strap element is adjustably clamped to the clamp element frame. Strap element 25 can be pulled through the clamp element frame in either direction, so as to vary the effective length of the loop formed by the strap means 20.

Strap means 22 has an adjustment mechanism to accommodate human girth dimension differences. One end of the strap means is looped around the side edge of a buckle 34 that is slidably adjustable on aforementioned strap element 25; strap element 25 threads through the buckle so as to overlie a cross bar 35 on the buckle, thereby holding the buckle in adjusted positions on the strap element 25.

Strap means 22 extends downwardly from buckle 34 and through anchorage element 24 before going around the back of the person. To effectively lengthen strap means 22 (for a fat person), buckle struture 34 is moved along strap element 25 toward clamp element 30. To effectively shorten strap means 22 (for a thin person), buckle structure 34 is moved along strap element 25 away from clamp element 30.

The buckle structure 34 is representative of various devices that can be used to vary the effective length of the lower strap means 22.

Flexible panel 12 supports four separate pocket structures, designated by numerals 38, 40, 42 and 44. Pocket structure 38 comprises a flap 45 integral with panel 12; the flap forms an integral extension of panel 12. Flap 45 extends upwardly from the lower edge of panel 12 in spaced relation to the panel front face, whereby the flap forms the front wall of pocket structure 38. Pocket structure 38 is completed by two connector walls 47 that join side edges of flap 45 to the side edges 18 of panel 12, e.g. by stitching along the flanged joints at edge areas of walls 47.

The upwardly open mouth of pocket structure 38 is normally closed by a hinged closure 48, preferably formed of leather or flexible plastic material; closure 48 has an upper edge hingedly attached to panel 12, e.g. by stitching, and a lower edge extending downwardly across the front wall of pocket structure 38. The facing surfaces of the pocket structure and closure 48 carry mating adhesive patches 50, whereby the closure is releasably held in the closed position. Patches 50 can be formed of fibrous interlocking hook-and-loop materials, e.g. materials marketed under the trademark VELCRO.

The second pocket structure 40 comprises a generally rectangular sheet of material 52 having its lower edge attached to the front face of flap 45. Side edges of flexible sheet 52 are attached to flap 45 by means of connector walls 53; each connector wall 53 can be an elongated strip tapering in the downward direction, so that the pocket structure 40 has a relatively wide mouth opening and closed lower end.

The mouth opening for pocket structure 40 is normally closed by a hinged closure 55 that is similar to aforementioned closure 48. Closure 55 is hingedly attached at its upper edge to the front face of pocket structure 38, e.g. by stitching. The lower edge area of closure 55 carries an adhesive patch 56 that mates with a complementary adhesive patch on sheet 52, whereby closure 55 is releasably held in place over the mouth opening of pocket structure 40. The adhesive patches can be formed of fibrous hook-and-loop fastener materials, similar to the materials used for patches 50, 26 and 28.

Pocket structure 42 is formed by a single strip of flexible material 58 having two relatively long side edges and a relatively short upper edge, and a relatively short lower edge. Strip 56 is stitched to the front face of pocket structure 38 (i.e. flap 45) by stitches running along its side edges and bottom edge. An additional row of stitches runs vertically along the vertical centerline of strip 58, so that pocket structure 42 is subdivided into two vertical compartments adapted to hold pens or pencils.

The right edge area of strip 58 may be continued forwardly to form one of the aforementioned connector walls 53, thereby simplifying the structure and enabling the pocket structure 40 to have a reasonably large width dimension.

The fourth pocket structure 44 occupies the space above pocket structure 38. It can be constructed similarly to the previously described pocket structure 40. Preferably pocket structure 44 is equipped with a hinged closure 60 constructed similarly to aforementioned closures 48 and 53. Closure 60 has an adhesive patch means 62 for holding the closure in place over the mouth opening of pocket structure 44.

The illustrated arrangement is advantageous in that it provides four separate pocket structures for various small articles. The articles can be separated from one another in different pocket structures, thus making it easier to find any particular article.

Another advantage of the illustrated arrangement is that the support panel 12 can have a reasonably large face area, such that a multiplicity of pocket structures of reasonable size can be provided on the panel. Each pocket structure is readily accessible.

Figure 4:
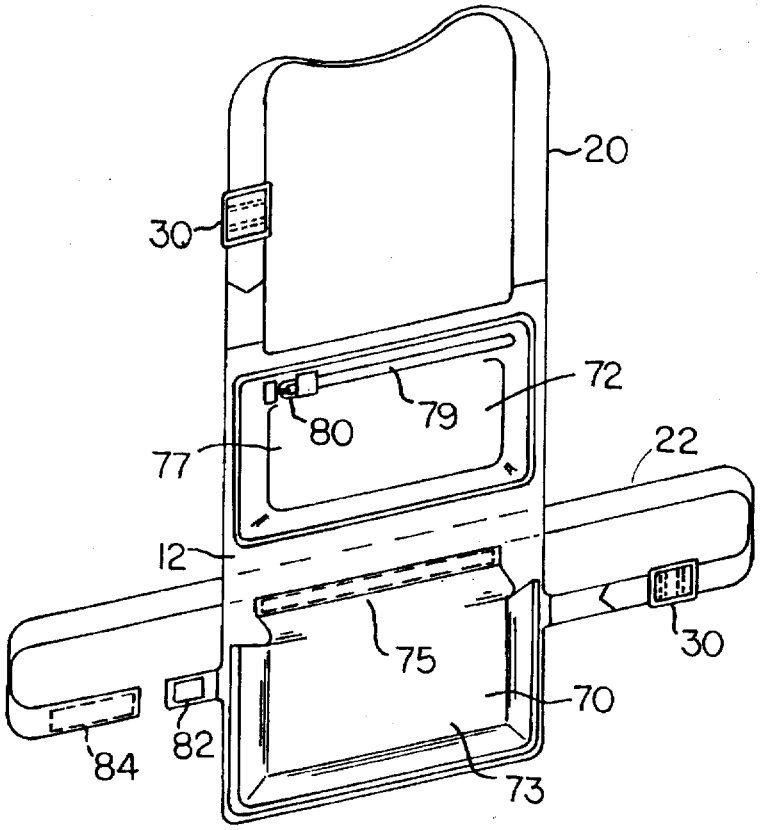
FIG. 4 is a perspective view of another article storage apparatus constructed according to the teachings of the invention.
Figure 3:
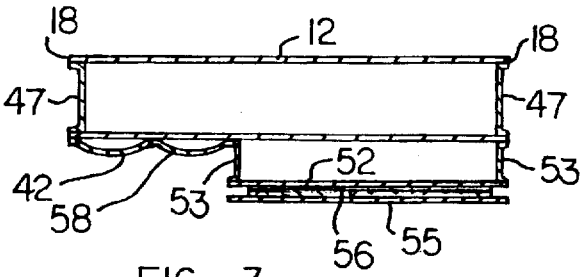
FIG. 3 is a transverse sectional view taken on line 3—3 in FIG. 1.

The number of pocket structures can be varied while still practicing the invention. FIG. 4 shows an alternate arrangement that comprises two pocket structures, namely a lower pocket structure 70 and an upper pocket structure 72.

Pocket structure 70 is shown as being comprised of a single fabric sheet 73 stitched along its bottom edge and two side edges to the support panel 12. Sheet 73 may be cut, stitched, and formed into a hollow three dimensional configuration, to give the pocket structure a desired depth. The upper edge area of sheet 73 provides a flap-type closure 75 that may be adhesively secured to panel 12, using adhesive patches of the previously described hook-and-loop materials.

Pocket structure 72 can be formed of a three dimensional fabric sheet 77 stitched around its peripheral edge to panel 12. A slot opening in sheet 77 can be closed by a conventional zipper 79 having a small key-operated lock 80 associated with the zipper pull tab. The hasp of the lock can be run through an opening in a fixed plate at the left end of the zipper system, to provide a secure theft-proof pocket structure.

As shown in FIG. 4, the lower strap means 22 has a length adjustment clamp means 30 that is similar to the adjustment device used for the upper strap means 20. Strap means 22 comprises an adhesive patch 82 carried on the right edge of panel 12, and a mating patch 84 on the free end of the elongated strap. The strap is adapted to encircle the upper torso of the person, in the previously described fashion.

The drawings illustrate at least one preferred form of the invention. However, it will be appreciated that the invention can be practiced in various forms and configurations.

What is claimed is:

1. An article storage apparatus comprising:

a flexible panel having a front face and a rear face, said rear face being adapted for positionment against a person's upper torso;

a plurality of article-containment pocket structures carried on said panel; each pocket structure having an access opening accesible to the person wearing the article storage apparatus;

a first strap means (20) having opposite ends thereof attached to said panel to form a flexible loop adapted to extend around a person's neck; and a second strap means (22) connected to said panel, and adapted to extend in a generally horizontal plane around the upper torso of a person, whereby the panel is retained in position against the person's torso;

said first strap means having a first length adjustment means (30);

said second strap means having a second length adjustment means; said second length, adjustment means comprising a buckle structure (34) attached to said second strap means for slidable adjusting movement along said first strap means, and an achorage element (24) carried by said panel; said second strap means extending from said buckle structure downwardly through said anchorage element for extension around the person's torso; said buckle structure being slidably adjustable on said first strap means to vary the spacing between said buckle structure and said anchorage element, so as to vary the relationship of said second strap means to the anchorage element.

* * * * *